US011255507B2

(12) United States Patent
Min

(10) Patent No.: US 11,255,507 B2
(45) Date of Patent: Feb. 22, 2022

(54) LAMP APPARATUS

(71) Applicant: HYUNDAI MOBIS CO., LTD., Seoul (KR)

(72) Inventor: Kyung Gu Min, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 16/858,385

(22) Filed: Apr. 24, 2020

(65) Prior Publication Data

US 2020/0340640 A1 Oct. 29, 2020

(30) Foreign Application Priority Data

Apr. 26, 2019 (KR) ..... 10-2019-0048847

(51) Int. Cl.

| | |
|---|---|
| ***F21S 43/27*** | (2018.01) |
| ***F21V 17/06*** | (2006.01) |
| ***F21S 43/20*** | (2018.01) |
| ***F21S 43/247*** | (2018.01) |
| ***F21S 43/241*** | (2018.01) |
| ***F21V 5/00*** | (2018.01) |
| ***F21S 41/143*** | (2018.01) |

(52) U.S. Cl.

CPC ..... *F21S 43/27* (2018.01); *F21S 41/143* (2018.01); *F21S 43/241* (2018.01); *F21S 43/247* (2018.01); *F21S 43/26* (2018.01); *F21V 5/007* (2013.01); *F21V 17/06* (2013.01)

(58) Field of Classification Search

CPC ..... F21V 5/007; F21V 17/04; F21V 17/06; F21S 41/143; F21S 41/151; F21S 41/153; F21S 41/24; F21S 43/241

See application file for complete search history.

(56) References Cited

U.S. PATENT DOCUMENTS

| | | | | |
|---|---|---|---|---|
| 7,914,162 | B1 * | 3/2011 | Huang | F21V 3/04 362/92 |
| 2012/0140463 | A1 * | 6/2012 | Kinzer | F21V 5/007 362/231 |
| 2020/0113022 | A1 * | 4/2020 | Cahalane | F21K 9/64 |

FOREIGN PATENT DOCUMENTS

KR 10-0950323 B1 3/2010

* cited by examiner

*Primary Examiner* — Sean P Gramling
(74) *Attorney, Agent, or Firm* — DLA Piper LLP (US)

(57) ABSTRACT

A lamp apparatus may include: a housing; a board housed in the housing; a plurality of light source modules mounted on the board and configured to generate light; an optic unit through which lights emitted from the plurality of light source modules enter and exit; a lens unit installed in the housing, and installed in front of the optic unit; and a control unit configured to individually turn on/off the plurality of light source modules.

14 Claims, 12 Drawing Sheets

LAMP APPARATUS

CROSS-REFERENCE TO RELATED APPLICATION

This application claims priority from and the benefit of Korean Patent Application No. 10-2019-0048847, filed on Apr. 26, 2019, which is hereby incorporated by reference for all purposes as if set forth herein.

BACKGROUND

Field

Exemplary embodiments of the present disclosure relate to a lamp apparatus, and more particularly, to a lamp apparatus which can not only reduce the part cost by decreasing the number of parts, but also improve the assembling efficiency by shortening the part assembling time.

Discussion of the Background

In general, a vehicle includes various lamps which have a lighting function for enabling a driver to easily check an object around the vehicle during night driving and a signal function for informing another vehicle or a road user of the driving state of the vehicle. Examples of the lamps include a turn signal lamp, a tail lamp, a brake lamp, a side marker and the like. However, the lamps having a signal function are installed in such a manner that one optic unit corresponds to one light source such as an LED. Therefore, the number of parts is increased, which results in raising the part cost. Therefore, there is a need for a device capable of solving the problem.

The related art of the present disclosure is disclosed in Korean Patent No. 10-0950323 registered on Mar. 23, 2010 and entitled "Exterior Lamp Driver of Car".

SUMMARY

Various embodiments are directed to a lamp apparatus which can not only reduce the part cost by decreasing the number of parts, but also improve the assembling efficiency by shortening the part assembling time.

In an embodiment, a lamp apparatus may include: a housing; a board housed in the housing; a plurality of light source modules mounted on the board and configured to generate light; an optic unit through which lights emitted from the plurality of light source modules enter and exit; a lens unit installed in the housing, and installed in front of the optic unit; and a control unit configured to individually turn on/off the plurality of light source modules.

The control unit may include: a central control unit configured to receive an operation signal from an input unit; and a light source control unit configured to receive the operation signal from the central control unit, and individually turn on/off the plurality of light source modules based on the operation signal.

Each of the light source modules may include one or more light sources configured to generate light.

The optic unit may include: a plurality of light entry modules having one or more light entry parts disposed at one or more positions corresponding to the one or more light sources, and facing the plurality of light source modules; an optic base part connected to the plurality of light entry modules; a light exit part connected to the optic base part, and located in front of the plurality of light entry modules such that lights emitted from the light entry modules exit through the light exit part; and a light guide part connected to the optic base part, covering the outer surfaces of the plurality of light entry modules, and configured to guide lights, entering the respective light entry modules, toward the light exit part.

The lamp apparatus may further include a fixing plate installed in the housing, and having a plurality of through-holes through which the plurality of optic units are disposed.

The fixing plate may include: a fixing plate body having the plurality of through-holes formed therein; and a fixing block which is disposed on a surface of the fixing plate body, facing the board, and to which a part of the optic unit is coupled.

The fixing plate may further include a spacer protruding from the surface of the fixing plate body, facing the board, toward the board, and brought into contact with the optic unit such that the optic unit and the fixing plate body are spaced at a preset distance apart from each other.

The fixing plate may further include a support part protruding from the surface of the fixing plate body, facing the board, toward the board, and configured to support the optic unit.

The optic base part may include: an optic base body connected to the plurality of light entry modules and the light exit part, brought into contact with the spacer, and supported by the support part; and an optic fixing protrusion extended from the optic base body to one side, and inserted into a fixing hole of the fixing block.

The lens unit may diffuse light received from the optic unit.

In accordance with the embodiment of the present disclosure, lights emitted from the plurality of light source modules enter and exit through one optic unit, and the plurality of light source modules are individually controlled through the control unit. Therefore, the number of parts can be decreased to reduce the part cost and the weight, and the part assembling time can be shortened to improve the assembling efficiency.

Furthermore, the optic unit can be easily located at the preset position through the fixing plate having the plurality of through-holes through which the plurality of optic units are respectively disposed.

Furthermore, the optic unit can be fixed at the preset position through the fixing block formed on the fixing plate.

Furthermore, since the optic unit and the fixing plate body are spaced at a preset distance apart from each other through the spacers formed on the fixing plate, the spacing distance therebetween can be maintained.

Furthermore, the optic unit can be more reliably fixed through the support part formed on the fixing plate.

DETAILED DESCRIPTION OF THE ILLUSTRATED EMBODIMENTS

Hereinafter, a lamp apparatus will be described below with reference to the accompanying drawings through various exemplary embodiments. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
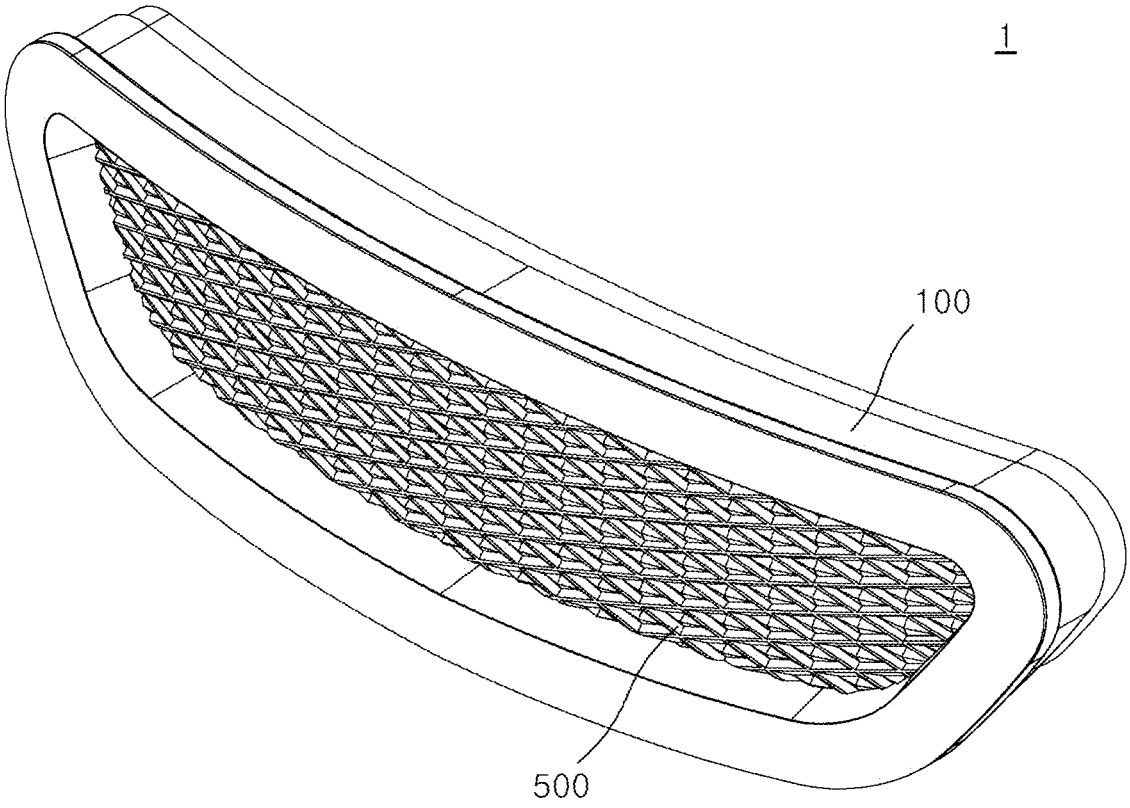
FIG. 1 is a perspective view of a lamp apparatus in accordance with an embodiment of the present disclosure.
Figure 2:
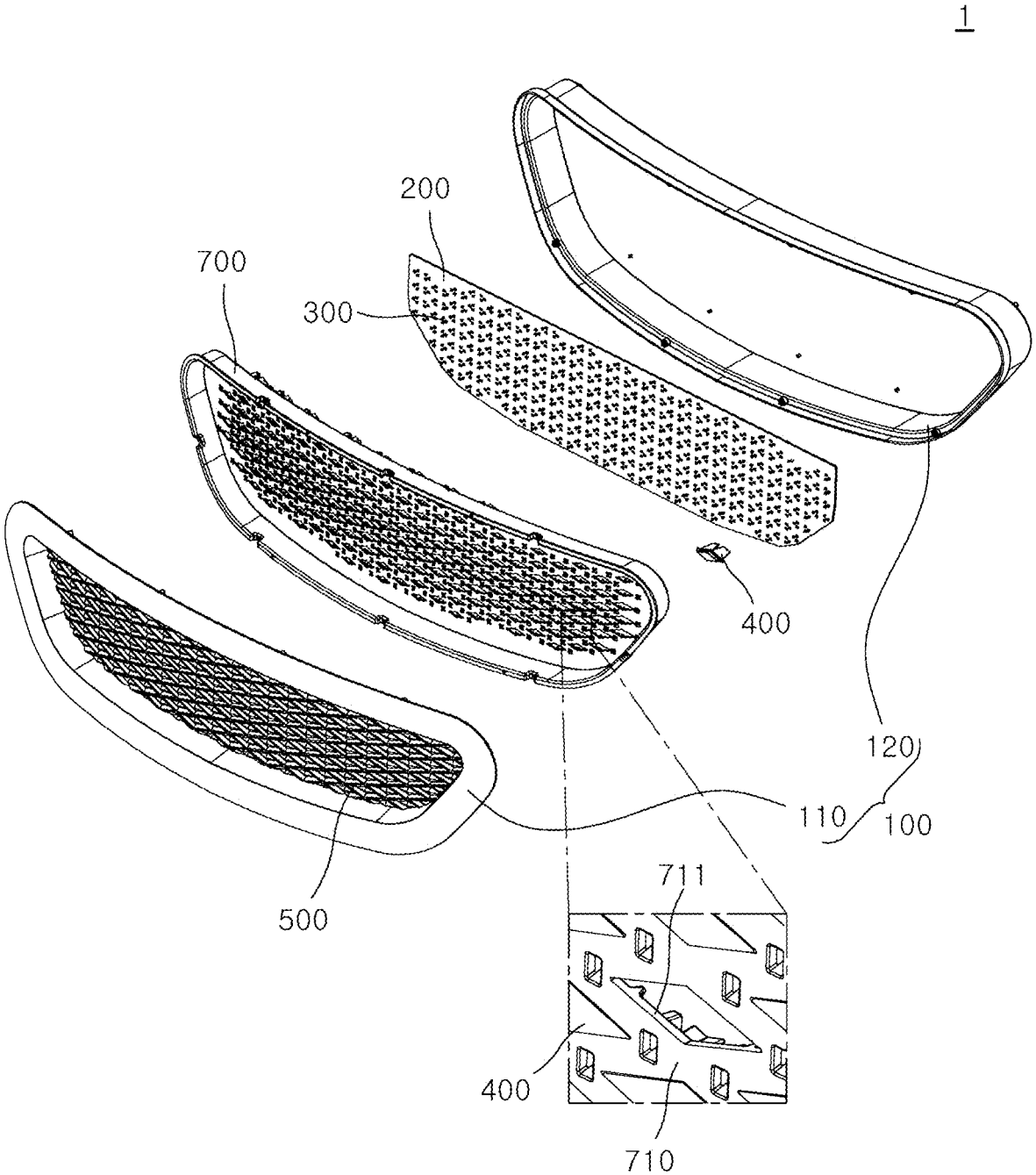
FIG. 2 is an exploded perspective view of the lamp apparatus in accordance with the embodiment of the present disclosure.
Figure 3:
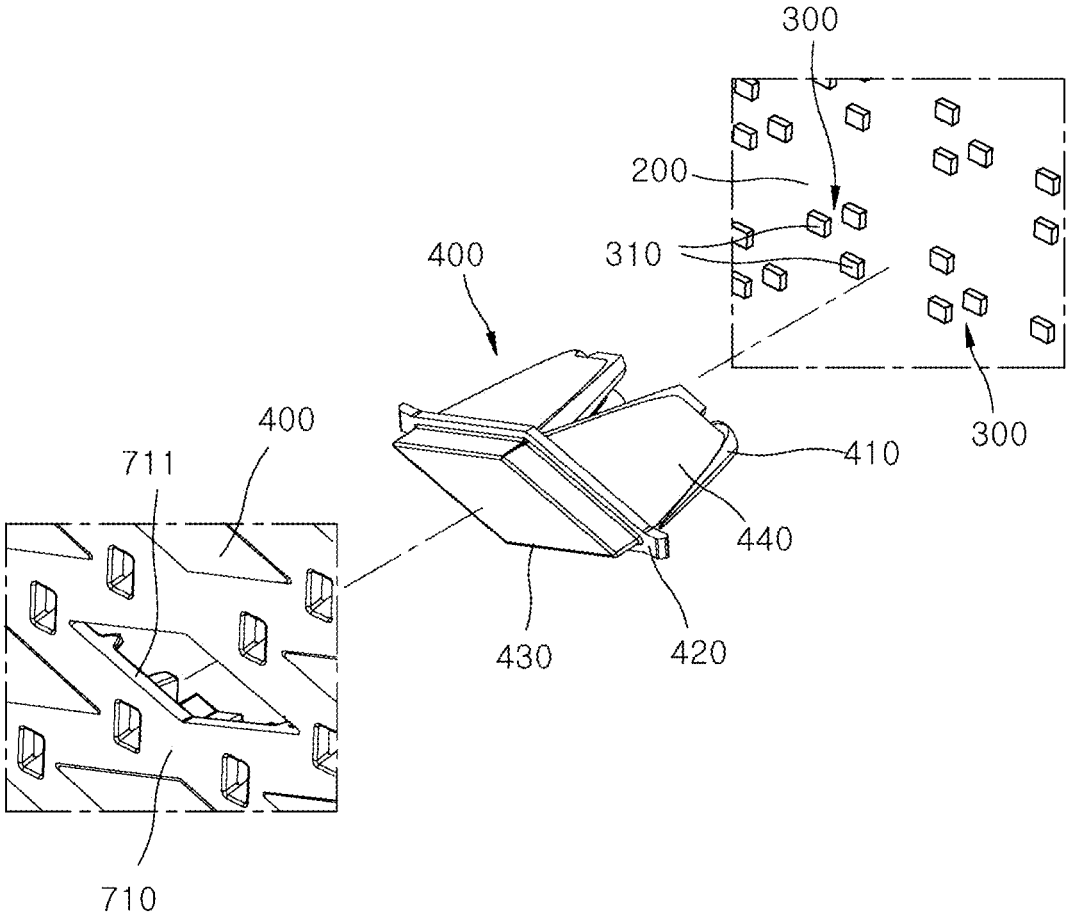
FIG. 3 is a view schematically illustrating main parts of FIG. 2.
Figure 4:
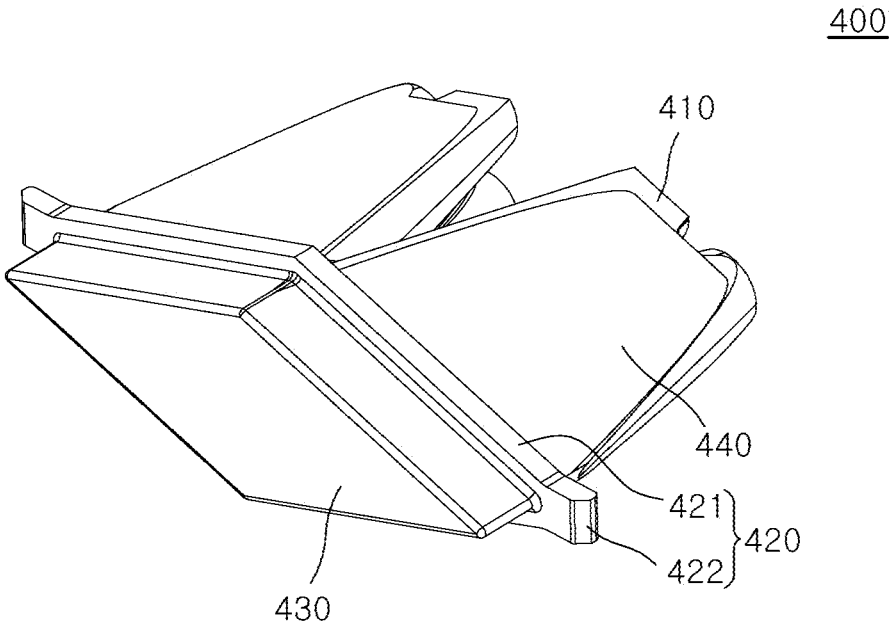
FIG. 4 is a diagram illustrating an optic unit of the lamp apparatus in accordance with the embodiment of the present disclosure.
Figure 5:
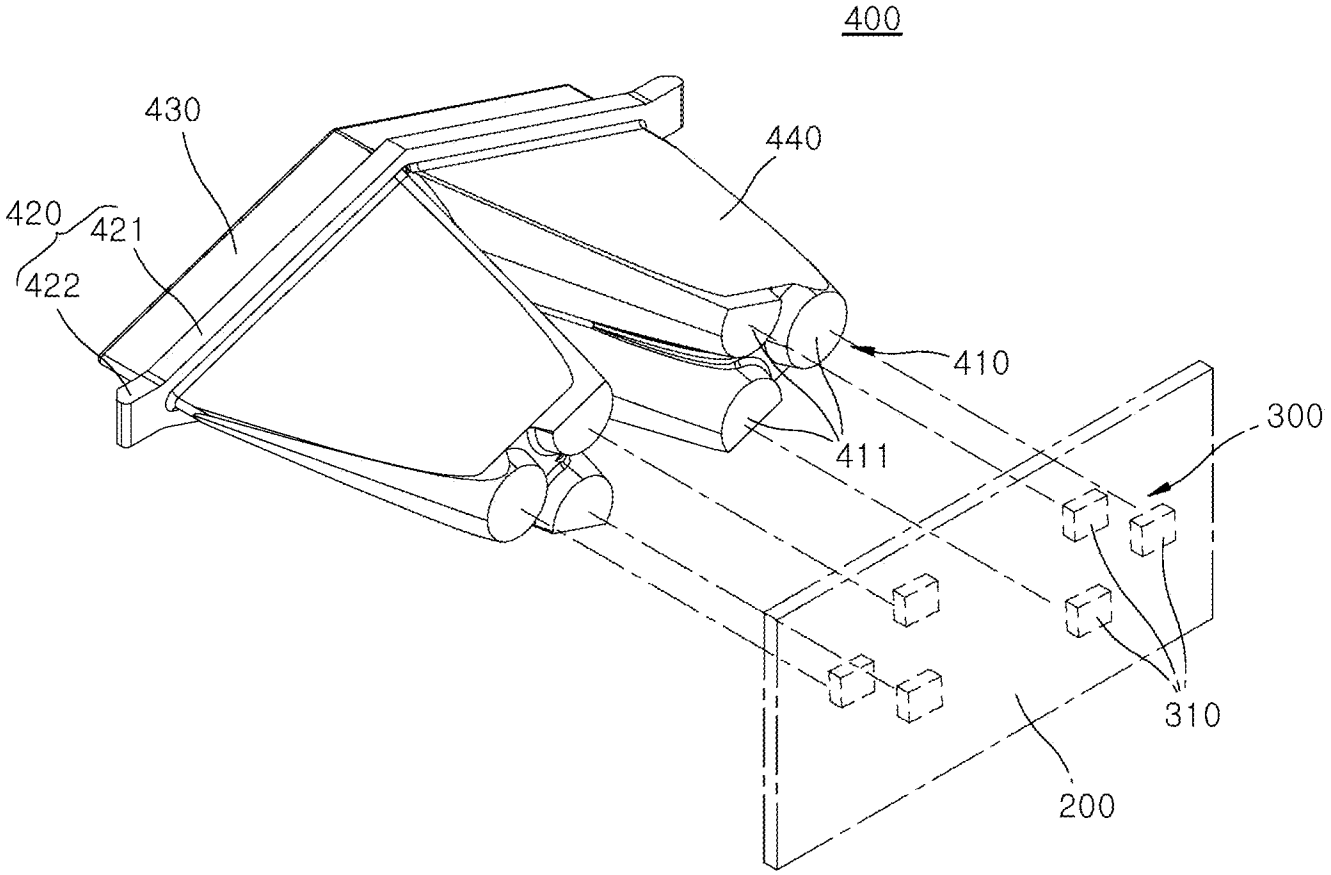
FIG. 5 is a diagram illustrating the optic unit of the lamp apparatus in accordance with the embodiment of the present disclosure, when seen in another direction.
Figure 6:
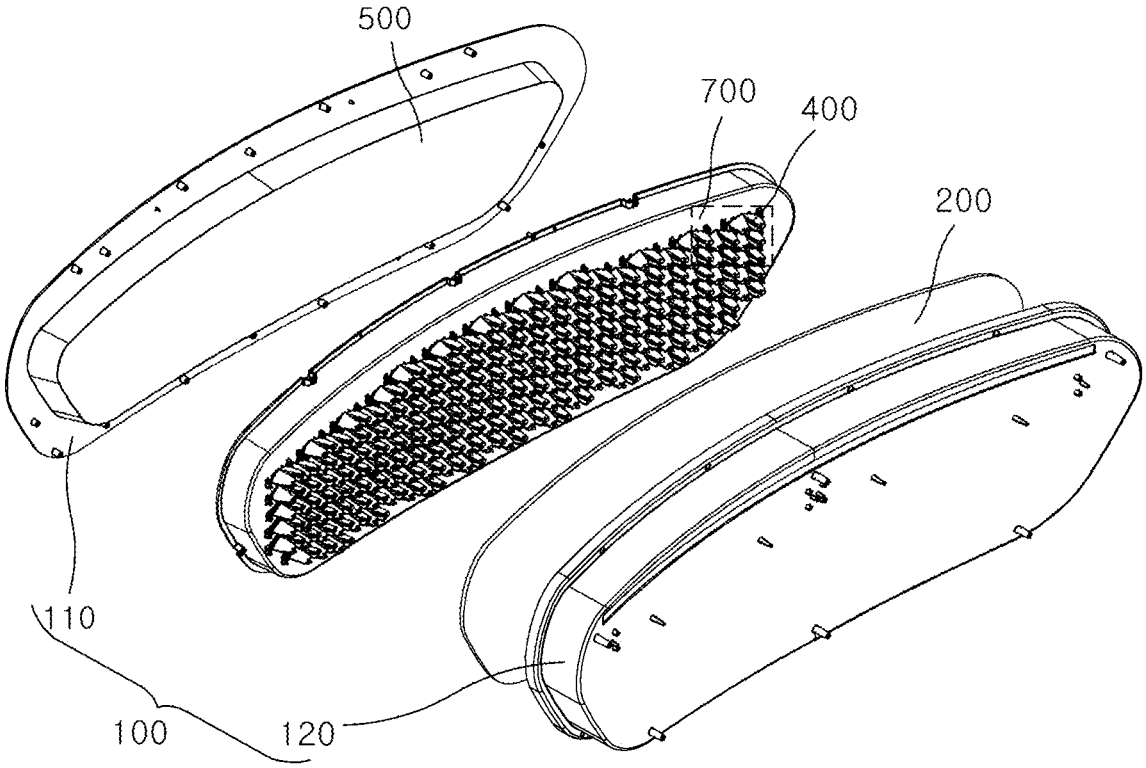
FIG. 6 is an exploded perspective view of the lamp apparatus in accordance with the embodiment of the present disclosure, when seen in another direction.
Figure 7:
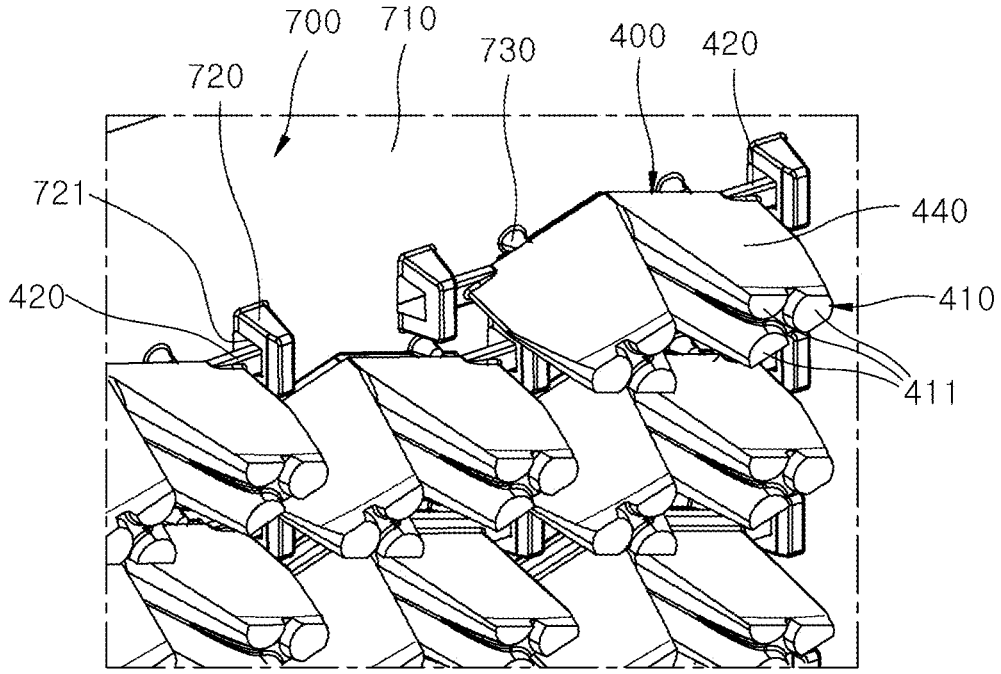
FIG. 7 is a diagram illustrating main parts of FIG. 6.
Figure 8:
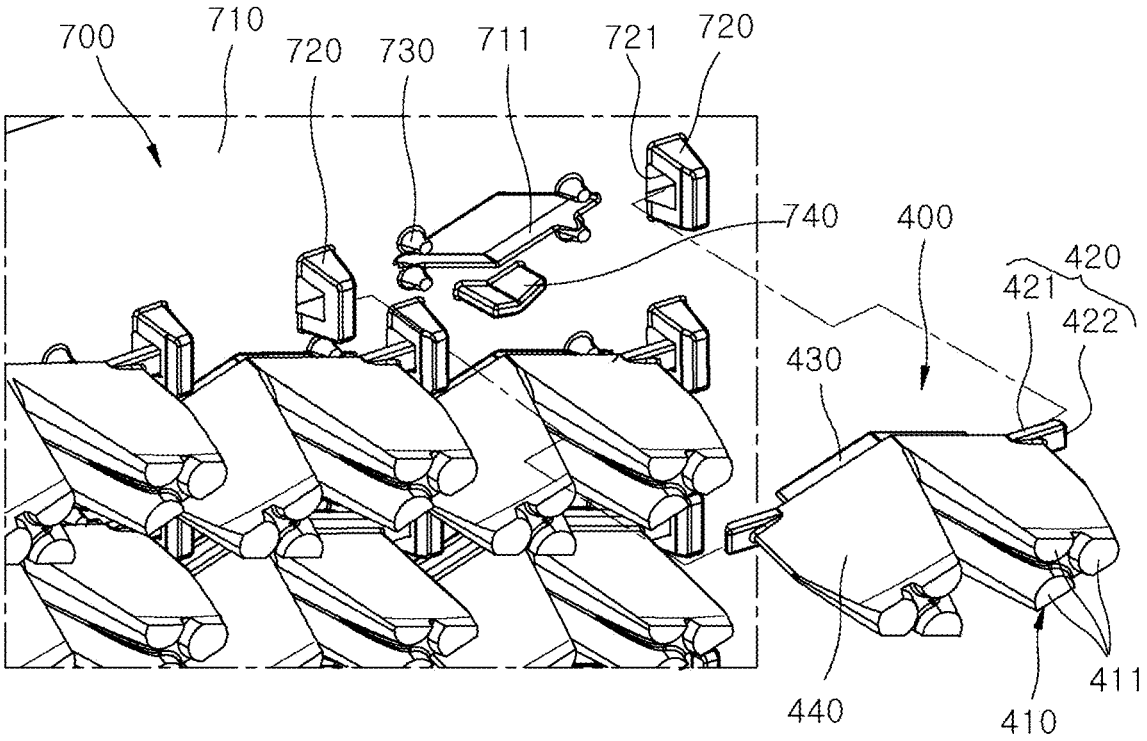
FIG. 8 is a diagram illustrating that the optic unit is disassembled from a fixing plate of FIG. 7.
Figure 9:
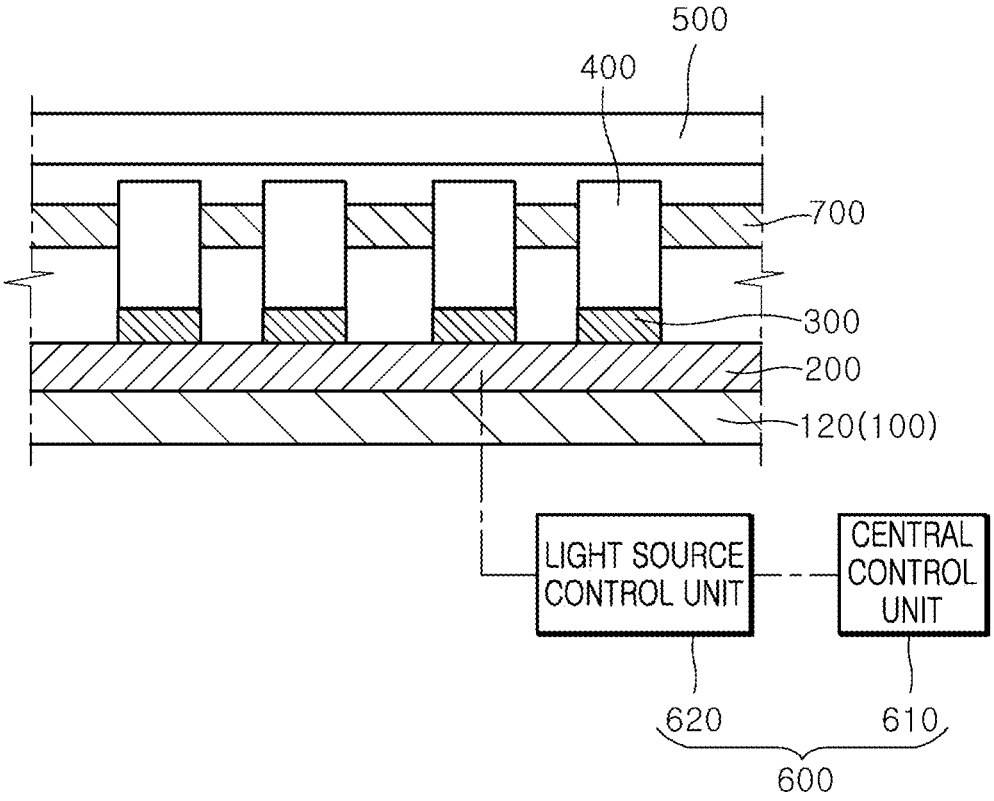
FIG. 9 is a diagram schematically illustrating a cross-section of the lamp apparatus in accordance with the embodiment of the present disclosure.
Figure 10A:
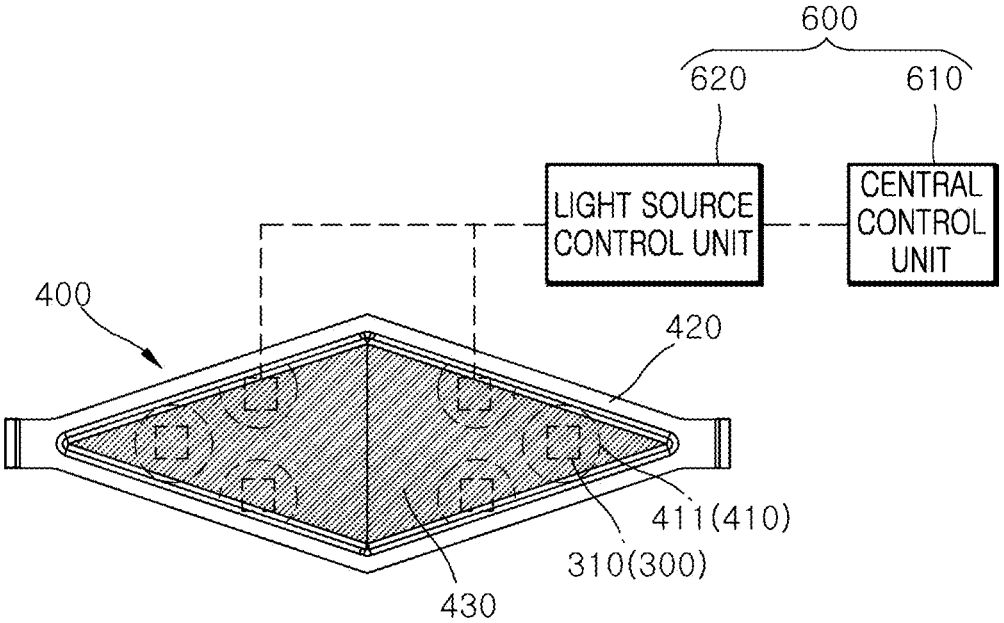
FIGS. 10A to 10D are diagrams illustrating various examples in which the optic unit in accordance with the embodiment of the present disclosure is operated.
Figure 10B:
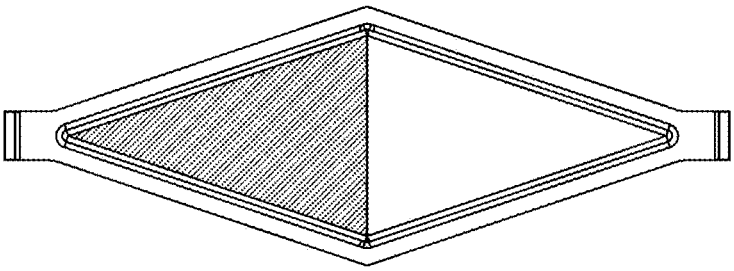
Figure 10C:
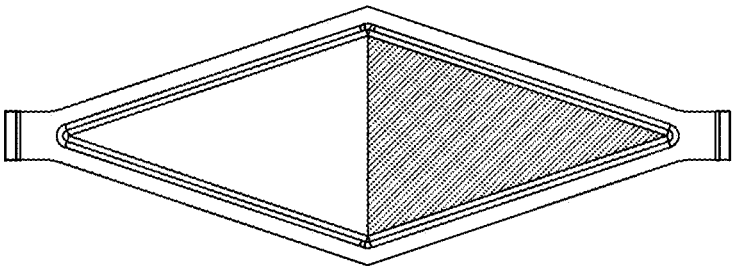
Figure 10D:
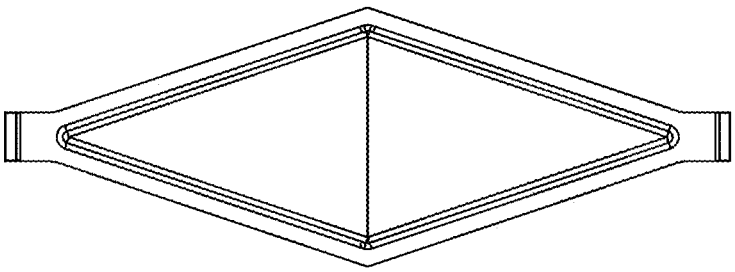
Figure 11:
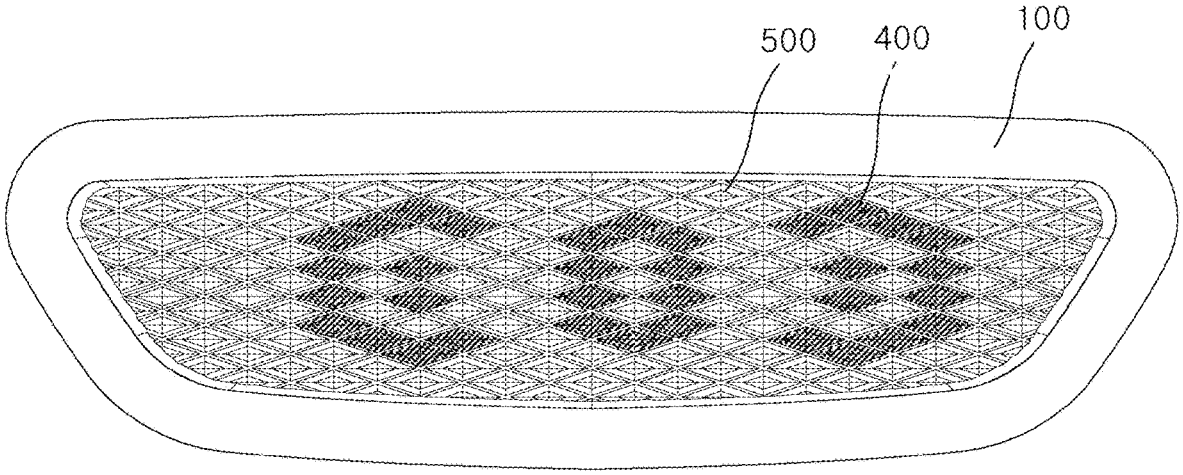
FIG. 11 is a diagram illustrating that the lamp apparatus in accordance with the embodiment of the present disclosure receives an operation signal through a control unit and visually implements characters corresponding to the operation signal.

FIG. 1 is a perspective view of a lamp apparatus in accordance with an embodiment of the present disclosure, FIG. 2 is an exploded perspective view of the lamp apparatus in accordance with the embodiment of the present disclosure, FIG. 3 is a view schematically illustrating main parts of FIG. 2, FIG. 4 is a diagram illustrating an optic unit of the lamp apparatus in accordance with the embodiment of the present disclosure, FIG. 5 is a diagram illustrating the optic unit of the lamp apparatus in accordance with the embodiment of the present disclosure, when seen in another direction, FIG. 6 is an exploded perspective view of the lamp apparatus in accordance with the embodiment of the present disclosure, when seen in another direction, FIG. 7 is a diagram illustrating main parts of FIG. 6, FIG. 8 is a diagram illustrating that the optic unit is disassembled from a fixing plate of FIG. 7, FIG. 9 is a diagram schematically illustrating a cross-section of the lamp apparatus in accordance with the embodiment of the present disclosure, FIGS. 10A to 10D are diagrams illustrating various examples in which the optic unit in accordance with the embodiment of the present disclosure is operated, and FIG. 11 is a diagram illustrating that the lamp apparatus in accordance with the embodiment of the present disclosure receives an operation signal through a control unit and visually implements characters corresponding to the operation signal.

Referring to FIGS. 1 to 8, a lamp apparatus 1 in accordance with an embodiment of the present disclosure includes a housing 100, a board 200, a plurality of light source modules 300, an optic unit 400, a lens unit 500 and a control unit 600. The board 200 is housed in the housing 100. The board 200 may be an FPCB (Field Programmable Circuit Board), i.e. a flexible printed circuit board.

The plurality of light source modules 300 are mounted on the board 200. Each of the light source modules 300 includes one or more light sources 310 configured to generate light. For example, each of the light source modules 300 may include three light sources 411. The plurality of light source modules 300 may be disposed on the board 200 so as to be spaced apart from each other (see FIG. 3).

The light source 310 may emit light in any one color of RGB (Red, Green Blue), white and turquoise. The light source 310 may emit green-color light to indicate autonomous driving. The plurality of light sources 310 may emit different colors of light or the same color of light.

The lights emitted from the plurality of light source modules 300 enter and exit through the optic unit 400. The optic unit 400 may include at least one of PC (Polycarbonate), PMMA (Polymethyl Methacrylate) and silicon.

The lens unit 500 is installed in the housing 100 and disposed in front of the optic unit 400. The lens unit 500 transmits the light received from the optic unit 400 to a forward area. The lens unit 500 may be made of a transparent material which transmits light.

The lens unit 500 diffuses the light received from the optic unit 400. The lens unit 500 is an inner lens serving as a light guide plate, and diffuses the light received from the optic unit 400 such that the light can be transferred to the forward area. As illustrated in the drawings, the lens unit 500 may have an unevenly processed outer surface. That is, the surface of the lens unit 500 may be processed in various shapes within such a range that the light received from the optic unit 400 can be diffused and transferred to the forward area.

The control unit 600 individually turns on/off the plurality of light source modules 300. Specifically, when a driver operates an input unit (not illustrated), an operation signal is generated by the input unit, and transferred to the control unit 600. At this time, the input unit may be an input button installed in a vehicle. The control unit 600 individually turns on/off the plurality of light source modules 300 based on the operation signal, and visually implements a character or image corresponding to the operation signal received from the input unit (see FIGS. 9 to 11).

The control unit 600 includes a central control unit 610 and a light source control unit 620. The central control unit 610 receives the operation signal from the input unit. The light source control unit 620 receives the operation signal from the central control unit 610, and individually turns on/off the plurality of light source modules 300 based on the operation signal.

When lights emitted from a pair of light source modules 300 enter and exit through one optic unit 400 as illustrated in FIGS. 10A to 10D, both of the pair of light source modules 300 may be turned on by the control unit 600 as illustrated in FIG. 10A, or turned off by the control unit 600 as illustrated in FIG. 10D. Furthermore, as illustrated in FIGS. 10B and 10C, any one of the pair of light source modules 300 may be turned on by the control unit 600, and the other of the pair of light source modules 300 may be turned off by the control unit 600.

In the lamp apparatus 1 in accordance with the embodiment of the present disclosure, lights emitted from the plurality of light source modules 300 may enter and exit through one optic unit 400, and the plurality of light source modules 300 may be individually controlled by the control unit 600. Therefore, the number of parts can be decreased to reduce the part cost, and the part assembling time can be shortened to improve the assembling efficiency.

The optic unit 400 includes a plurality of light entry modules 410, an optic base part 420, a light exit part 430 and a light guide part 440. Each of the light entry modules 410 includes one or more light entry parts 411 disposed at one or more locations corresponding to the one or more light sources 310, and faces the corresponding light source module 300. The light entry part 411 may be formed in a pillar shape.

For example, the optic unit 400 may include a pair of light entry modules 410, each of which has three light entry parts 411 and which are disposed at locations corresponding to a pair of light source modules 300 each having three light sources 310 (see FIGS. 3 and 4). At this time, a cross-section formed by the pair of light entry modules 410 may have a diamond shape.

For another example, the optic unit 400 may include four light entry modules 410, each of which has one light entry part 411 and which are disposed at locations corresponding to fourth light source modules 300 each having one light source 310. At this time, a cross-section formed by the four light entry modules 410 may have a rectangular shape.

The numbers of the light sources 310 and the light source modules 300 may be changed depending on conditions, and the numbers of the light entry parts 411 and the light entry modules 410 may also be changed in response to the numbers of the light sources 310 and the light source modules 300. Furthermore, the cross-section formed by the light source modules 300 may be changed to various cross-sectional shapes such as a circle depending on conditions.

Since the optic unit 400 includes the plurality of light entry modules 410 through which lights emitted from the respective light source modules 300 enter, the number of parts can be reduced more than in the related art in which light emitted from one light source enters and exits through one optic unit. Thus, the weight of the lamp apparatus 1 can be reduced.

The optic base part 420 is connected to the plurality of light entry modules 410. The light entry module 410 may be disposed on the inner surface of the optic base part 420 so as to be connected to the optic base part 420.

The light exit part 430 is connected to the optic base part 420, and located in front of the plurality of light entry modules 410, such that lights emitted from the light entry modules 410 exit through the light exit part 430. The light exit part 430 may have a cross-sectional shape corresponding to the cross-sectional shape formed by the plurality of light entry modules 410. For example, when the cross-section formed by the plurality of light entry modules 410 is a diamond shape, the light exit part 430 may have a diamond-shaped cross-section corresponding to the cross-section (see FIGS. 4 and 5).

The light guide part 440 is connected to the optic base part 420, covers the outer surfaces of the plurality of light entry modules 410, and guides lights, entering the respective light entry modules 410, toward the light exit part 430. The light guide part 440 is extended from the optic base part 420 to one side, and covers the outer surfaces of the light entry modules 410 such that lights emitted from the plurality of light source modules 300 are guided to the light entry modules 410.

The lamp apparatus 1 further includes a fixing plate 700 (see FIGS. 6 to 8). The fixing plate 700 is installed in the housing 100, and has a plurality of through-holes 711 through which the plurality of optic units 400 are respectively disposed. Thus, the optic units 400 may be easily located at preset positions.

The fixing plate 700 includes a fixing plate body 710 and fixing blocks 720. The fixing plate body 710 has the plurality of through-holes 711 formed therein. The fixing blocks 720 are disposed on a surface of the fixing plate body 710, facing the board 200, and a part of the optic unit 400 is coupled to each of the fixing blocks 720. Specifically, the fixing blocks 720 may be configured as a pair of fixing blocks disposed on both sides of the optic base part 420. The fixing blocks 720 have fixing holes 721 into which a pair of optic fixing protrusions 422 of the optic base part 420 to be described below are respectively inserted. Thus, the optic unit 400 may be fixed to the preset position.

The fixing plate 700 further includes spacers 730. The spacers 730 may protrude from the surface of the fixing plate body 710, facing the board 200, toward the board 200, and be brought into contact with the optic unit 400 such that the optic unit 400 and the fixing plate body 710 are spaced at a preset distance apart from each other. As illustrated in FIG. 8, the plurality of spacers 730 are disposed on the fixing plate body 710 so as to be spaced at a preset distance apart from each other, and brought into contact with an optic base body 421 of the optic base part 420 such that the optic unit 400 and the fixing plate body 710 are spaced at the preset distance apart from each other. At this time, the spacer 730 and the optic base body 421 may be brought into contact with each other through a flat surface. Thus, the optic unit 400 and the fixing plate body 710 may be spaced at the preset distance apart from each other, and the spacing distance may be maintained.

The fixing plate 700 further includes a support part 740. The support part 740 protrudes from the surface of the fixing plate body 710, facing the board 200, toward the board 200, and supports the optic unit 400. As illustrated in FIG. 8, the support part 740 supports the bottom surface of the optic unit 400, such that the optic unit 400 can be fixed more reliably.

The optic base part 420 includes the optic base body 421 and the optic fixing protrusion 422. The optic base body 421 is connected to the plurality of light entry modules 410 and the light exit part 430, brought into contact with the spacer 730, and supported by the support part 740. The optic fixing protrusion 422 is extended from the optic base body 421 to one side, and inserted into the fixing hole 721 of the fixing block 720. That is, the optic fixing protrusion 422 may be configured as a pair of optic fixing protrusions which are extended from both sides of the optic base body 421, and inserted into the fixing holes 721 of the pair of fixing blocks 720.

In the lamp apparatus 1 in accordance with the embodiment of the present disclosure, lights emitted from the plurality of light source modules 300 can enter and exit through one optic unit 400, and the control unit 600 can individually control the plurality of light source modules 300 to visually implement a character or image corresponding to an operation signal received from the input unit. Therefore, the number of parts can be decreased to reduce the part cost and the weight. Furthermore, the part assembling time can be shortened to improve the assembling efficiency.

Furthermore, the optic unit 400 can be easily assembled at the preset position through the fixing plate 700. Furthermore, the optic unit 400 assembled at the preset position may be maintained in a fixed state.

Although exemplary embodiments of the disclosure have been disclosed for illustrative purposes, those skilled in the art will appreciate that various modifications, additions and substitutions are possible, without departing from the scope and spirit of the disclosure as defined in the accompanying claims. Thus, the true technical scope of the disclosure should be defined by the following claims.

What is claimed is:

1. A lamp apparatus comprising:

a housing;

a board housed in the housing;

a plurality of light source modules mounted on the board, each of the plurality of light source modules comprising one or more light sources configured to generate light;

a plurality of optic units configured to receive the light from the plurality of light source modules, the plurality of optic units including a first optic unit comprising:

a plurality of light entry modules including one or more light entry parts disposed at one or more positions corresponding to the one or more light sources and facing the plurality of light source modules, and an optic base part connected to the plurality of light entry modules;

a lens unit installed in the housing and configured to receive the light from the plurality of optic units;

a fixing plate installed in the housing and including:

a fixing plate body having formed therein a plurality of through-holes into which the plurality of optic units are inserted, wherein the fixing plate and the optic base part are configured so that the first optic unit and the fixing plate body are spaced at a preset distance apart from each other, a fixing block disposed on a surface of the fixing plate body facing the board and configured to be coupled to the first optic unit, and a spacer protruding from the fixing plate body facing the board and configured to support the first optic unit; and a control unit configured to individually turn on/off the plurality of light source modules.

2. The lamp apparatus of claim 1, wherein the control unit comprises:

a central control unit configured to receive an operation signal from an input unit; and a light source control unit configured to receive the operation signal from the central control unit, and individually turn on/off the plurality of light source modules based on the operation signal.

3. The lamp apparatus of claim 1, wherein the first optic unit further comprises:

a light exit part connected to the optic base part and located on an opposite side from the plurality of light entry modules such that the light entering the first optic unit through the plurality of light entry modules exits the first optic unit through the light exit part; and a light guide part connected to the optic base part and covering outer surfaces of the plurality of light entry modules, wherein the light guide part is configured to guide the light entering the first optic unit through the plurality of light entry modules toward the light exit part.

4. The lamp apparatus of claim 1 wherein the fixing plate further comprises a support part protruding from the surface of the fixing plate body, facing the board, toward the board, and configured to support one of the plurality of optic units.

5. The lamp apparatus of claim 1, wherein the optic base part comprises:

an optic base body connected to the plurality of light entry modules and the light exit part, configured to contact the spacer, and supported by a support part of the fixing plate; and an optic fixing protrusion extended from the optic base body to one side, and inserted into one of the through-holes.

6. The lamp apparatus of claim 1, wherein the lens unit is configured to diffuse light received from the plurality of optic units.

7. A lamp apparatus comprising:

a housing;

a board housed in the housing;

a plurality of light source modules mounted on the board, each of the plurality of light source modules comprising one or more light sources configured to generate light;

a plurality of optic units configured to receive the light from the plurality of light source modules, the plurality of optic units including a first optic unit comprising:

a plurality of light entry modules including one or more light entry parts disposed at one or more positions corresponding to the one or more light sources and facing the plurality of light source modules, and an optic base part connected to the plurality of light entry modules;

a lens unit installed in the housing and configured to receive the light from the plurality of optic units; and a control unit configured to individually turn on/off the plurality of light source modules, wherein the optic base part comprises:

an optic base body connected to the plurality of light entry modules and the light exit part, configured to contact a spacer of the fixing plate, and supported by a support part of the fixing plate; and an optic fixing protrusion extended from the optic base body to one side, and inserted into a fixing hole of a fixing block of the fixing plate.

8. The lamp apparatus of claim 7, wherein the control unit comprises:

a central control unit configured to receive an operation signal from an input unit; and a light source control unit configured to receive the operation signal from the central control unit, and individually turn on/off the plurality of light source modules based on the operation signal.

9. The lamp apparatus of claim 7, further comprising a fixing plate installed in the housing and including a plurality of through-holes into which the plurality of optic units are inserted.

10. The lamp apparatus of claim 7, wherein the first optic unit further comprises:

a light exit part connected to the optic base part and located on an opposite side from the plurality of light entry modules such that the light entering the first optic unit through the plurality of light entry modules exits the first optic unit through the light exit part; and a light guide part connected to the optic base part and covering outer surfaces of the plurality of light entry modules, wherein the light guide part is configured to guide the light entering the first optic unit through the plurality of light entry modules toward the light exit part.

11. The lamp apparatus of claim 9, wherein the fixing plate comprises:

a fixing plate body having the plurality of through-holes formed therein; and a fixing block disposed on a surface of the fixing plate body and facing the board, wherein the fixing block is configured to be coupled to a part of one of the plurality of optic units.

12. The lamp apparatus of claim 11, wherein the fixing plate further comprises a spacer protruding from the surface or the fixing body, facing the board, toward the board, and configured to contact the first optic unit of the plurality of optic units such that the first optic unit and the fixing plate body are spaced at a preset distance apart from each other.

13. The lamp apparatus of claim 11, wherein the fixing plate further comprises a support part protruding from the surface of the fixing plate body, facing the board, toward the board, and configured to support one of the plurality of optic units.

14. The lamp apparatus of claim 7, wherein the lens unit is configured to diffuse light received from the plurality of optic units.

* * * * *